US010435835B2

(12) United States Patent
Lee et al.

(10) Patent No.: US 10,435,835 B2
(45) Date of Patent: Oct. 8, 2019

(54) AUXILIARY WASHING MACHINE AND LAUNDRY TREATMENT APPARATUS USING THE SAME

(71) Applicant: LG ELECTRONICS INC., Seoul (KR)

(72) Inventors: Jihong Lee, Seoul (KR); Wooseong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 14/726,347

(22) Filed: May 29, 2015

(65) Prior Publication Data

US 2015/0345071 A1 Dec. 3, 2015

(30) Foreign Application Priority Data

May 30, 2014 (KR) ..... 10-2014-0065891
May 19, 2015 (KR) ..... 10-2015-0069662

(51) Int. Cl.

| | |
|---|---|
| ***D06F 29/00*** | (2006.01) |
| ***D06F 39/08*** | (2006.01) |
| ***D06F 39/12*** | (2006.01) |
| *D06F 23/04* | (2006.01) |
| *D06F 37/24* | (2006.01) |

(52) U.S. Cl.

CPC ..... *D06F 39/088* (2013.01); *D06F 29/00* (2013.01); *D06F 39/083* (2013.01); *D06F 39/12* (2013.01); *D06F 23/04* (2013.01); *D06F 37/24* (2013.01)

(58) Field of Classification Search

CPC .... D06F 39/008; D06F 39/088; D06F 39/083; D06F 37/18; D06F 37/266; D06F 39/14

See application file for complete search history.

(56) References Cited

U.S. PATENT DOCUMENTS 3,111,952 A * 11/1963 Roehl ..... C23G 5/04 134/105
5,315,727 A * 5/1994 Lee ..... D06F 37/28 68/18 C (Continued)

FOREIGN PATENT DOCUMENTS

CN 101407990 4/2009
CN 101578409 11/2009

(Continued)

OTHER PUBLICATIONS

Chinese Office Action in Chinese Application No. 201510289407.5, dated Dec. 28, 2016, 15 pages (with English translation).

(Continued)

*Primary Examiner* — Joseph L. Perrin
*Assistant Examiner* — Irina Graf
(74) *Attorney, Agent, or Firm* — Fish & Richardson P.C.

(57) ABSTRACT

A laundry treatment apparatus includes a cabinet and a drawer retractably provided in the cabinet. An accommodation unit is disposed in the drawer and defines a space configured to receive washing water. A water supply channel is connected to a water supply source and is configured to supply washing water to the accommodation unit. The laundry treatment apparatus includes a body along which a water supply channel is provided, the body being rotatably provided at the cabinet. A body guider is provided at the cabinet and is configured to guide a rotational movement of the body.

32 Claims, 10 Drawing Sheets

(56) References Cited

U.S. PATENT DOCUMENTS

| | | | | |
|---|---|---|---|---|
| 7,850,784 | B2 * | 12/2010 | Gunnerson | A47L 15/0084 134/114 |
| 9,945,064 | B2 | 4/2018 | Lee et al. | |
| 10,221,516 | B2 | 3/2019 | Lee et al. | |
| 2007/0220709 | A1 | 9/2007 | Hill | |
| 2009/0139276 | A1 * | 6/2009 | Kim | D06F 23/02 68/17 R |
| 2009/0145175 | A1 | 6/2009 | Kim et al. | |
| 2010/0107704 | A1 * | 5/2010 | Seo | D06F 39/02 68/17 R |
| 2010/0170542 | A1 * | 7/2010 | Cosgrove | A47L 15/4263 134/115 R |
| 2010/0307200 | A1 | 12/2010 | Jeong et al. | |
| 2011/0120195 | A1 * | 5/2011 | Jeoung | D06F 39/14 68/139 |
| 2011/0265524 | A1 | 11/2011 | Kim | |
| 2013/0047680 | A1 | 2/2013 | Han et al. | |
| 2013/0214660 | A1 | 8/2013 | Coxon | |

FOREIGN PATENT DOCUMENTS

| | | | |
|---|---|---|---|
| CN | 101617077 | | 12/2009 |
| CN | 101725015 | | 6/2010 |
| CN | 101815460 | | 8/2010 |
| CN | 102292494 | | 12/2011 |
| CN | 102844486 | | 12/2012 |
| EP | 2 700 743 | A2 | 2/2014 |
| EP | 2 857 569 | A1 | 4/2015 |
| JP | 2001-046308 | | 2/2001 |
| JP | 2001-157796 | | 6/2001 |
| JP | 2001314695 | A * | 11/2001 |
| JP | 2002-159786 | | 6/2002 |
| JP | 2002-291677 | | 10/2002 |
| WO | WO 2008/069607 | A2 | 6/2008 |
| WO | 2009/072198 | | 6/2009 |
| WO | 20090142354 | | 11/2009 |
| WO | WO 2010/131883 | A2 | 11/2010 |
| WO | 2012150539 | | 11/2012 |
| WO | 2014030961 | | 2/2014 |

OTHER PUBLICATIONS

European Search Report in European Application No. 16189588, dated Feb. 9, 2017, 9 pages (with English translation).

European Search Report dated Oct. 15, 2015, for European Application No. 15170117.4, 5 pages.

Chinese Office Action in Chinese Application No. 201610693938.5, dated Jan. 2, 2018, 13 pages (with English translation).

Chinese Office Action in Chinese Application No. 201610696371.7, dated Nov. 3, 2017, 21 pages (with English translation).

United States Office Action in U.S. Appl. No. 15/281,221, dated Jun. 20, 2018, 21 pages.

United States Office Action in U.S. Appl. No. 15/281,190, dated Jul. 11, 2018, 22 pages.

United States Notice of Allowance in U.S. Appl. No. 15/281,211, dated Jun. 19, 2019, 9 pages.

United States Notice of Allowance in U.S. Appl. No. 15/281,190, dated Jul. 25, 2019, 10 pages.

* cited by examiner

AUXILIARY WASHING MACHINE AND LAUNDRY TREATMENT APPARATUS USING THE SAME

CROSS-REFERENCE TO RELATED APPLICATIONS

This application claims the benefit of Korean Patent Application No. 10-2014-0065891, filed on May 30, 2014, and Korean Patent Application No. 10-2015-0069662, filed on May 19, 2015, the contents of which are hereby incorporated by reference in their entirety.

TECHNICAL FIELD

The present disclosure relates to a laundry treatment apparatus.

BACKGROUND

Generally, a laundry treatment apparatus is understood to include an apparatus adapted to wash laundry, an apparatus adapted to dry laundry, and an apparatus adapted to perform both washing and drying of laundry.

A front-loading laundry treatment apparatus (also called a drum washing machine) is constructed to allow laundry to be put into the apparatus from the front of the apparatus and has an introduction port through which laundry can be put into the apparatus. Since the front-loading laundry treatment apparatus has an introduction port positioned at a level lower than a user's waist, use of the apparatus is inconvenient in that a user has to stoop when the user puts laundry into the apparatus or takes laundry out of the apparatus.

In order to eliminate such inconvenience, among conventional laundry treatment apparatuses, a laundry treatment apparatus in which a support platform is additionally provided at a front-loading laundry treatment apparatus has been proposed.

However, the support platform provided at the conventional laundry treatment apparatus is merely intended to raise the height of an introduction port and cannot perform a function of laundry treatment such as washing or drying of laundry.

SUMMARY

A laundry treatment apparatus is detachably coupled to another laundry treatment apparatus to perform functions of washing and/or drying of laundry. In some implementations, the laundry treatment apparatus enables washing water to be easily supplied to or discharged from an accommodation unit retractably provided at a cabinet to accommodate laundry. In some implementations, the laundry treatment apparatus is configured to condense moisture discharged from the accommodation unit and to return the condensed water to the accommodation unit. The laundry treatment apparatus may also be configured to prevent washing water from remaining in a discharge unit serving to discharge washing water contained in an accommodation unit. In some implementations, the laundry treatment apparatus may be configured to circulate washing water in an accommodation unit.

A laundry treatment apparatus includes a cabinet and a drawer retractably provided in the cabinet. An accommodation unit is disposed in the drawer and defines a space configured to receive washing water. A water supply channel is connected to a water supply source and is configured to supply washing water to the accommodation unit. The laundry treatment apparatus also includes a body along which a water supply channel is provided. The body is rotatably provided at the cabinet, and a body guider is provided at the cabinet and is configured to guide a rotational movement of the body.

In some implementations, the water supply channel is formed as an internal channel inside the body.

In some implementations, the water supply channel is formed as an external water pipe supported by the body.

In some implementations, the body guider is configured to provide upward directional support for the body.

In some implementations, the laundry treatment apparatus includes a first guider holder provided at the body; and a second guider holder provided along the body guider and along which the first guider holder is movably supported.

In some implementations, the second guider holder includes at least one of a protruding rail that is formed along the body guider, or a groove that is formed along the body guider. The first guider holder includes a hook that is configured to protrude from the body and is configured to be movably coupled to the second guider holder.

In some implementations, the body guider is fixed to the cabinet to be positioned above the drawer, and the body is vertically positioned between the body guider and the drawer.

In some implementations, the laundry treatment apparatus includes a water discharge channel configured to discharge washing water from the accommodation unit to the outside of the cabinet. A first frame is rotatably provided at the drawer and is configured to support the water discharge channel. A second frame is rotatably provided at the cabinet and is configured to support the water discharge channel. A frame rotating shaft is configured to rotatably connect the first frame to the second frame.

In some implementations, a first end of the first frame is rotatably connected to the drawer, and a first end of the second frame is rotatably connected to the cabinet. The frame rotating shaft rotatably connects a second end of the first frame with a second end of the second frame.

In some implementations, the laundry treatment apparatus includes a water discharge channel that is provided along the body and that is configured to discharge washing water from the accommodation unit to the outside of the accommodation unit. The body is positioned at an upper portion of a rear surface of the drawer.

In some implementations, the water discharge channel is formed as an internal channel inside the body.

In some implementations, the water discharge channel is formed as an external water pipe supported by the body.

In some implementations, the body is configured to have a recessed portion that is configured to accommodate an upper edge of the rear surface of the drawer when the drawer in a closed position.

In some implementations, the body defines a washing water channel that is divided into a first supply channel and a first discharge channel by a partition. In some implementations, the first supply channel is vertically positioned above the drawer to be parallel to an upper surface of the drawer, and the first discharge channel is positioned behind the drawer to be parallel to a rear surface of the drawer when the drawer is in the closed position.

In some implementations, the water supply channel includes the first supply channel, a connecting pipe that is connected between the first supply channel and the water supply source, and a water supply pipe connected between the first supply channel and the accommodation unit. Additionally, the water discharge channel includes the first discharge channel, a first water discharge pipe that is connected between the first discharge channel and the accommodation unit, and a second water discharge pipe connected between the first discharge channel and the outside of the cabinet.

In some implementations, the laundry treatment apparatus includes a water discharge channel configured to discharge washing water from the accommodation unit to the outside of the accommodation unit. In addition, the water supply channel includes a first supply channel provided along an interior of the body, a connecting pipe connected between the first supply channel and the water supply source, and a water supply pipe connected between the first supply channel and the accommodation unit. The water discharge channel is supported along an exterior of the body.

In some implementations, the laundry treatment apparatus includes a water discharge channel configured to discharge washing water from the accommodation unit to the outside of the accommodation unit. The water supply channel is supported along an exterior of the body. In addition, the water discharge channel includes a first discharge channel provided along an interior of the body, a first water discharge pipe that is connected between the first discharge channel and the accommodation unit, and a second water discharge pipe that is connected between the first discharge channel and the outside of the cabinet.

In some implementations, the body includes a base rotatably coupled to the cabinet; and a cover coupled to the base such that the base and the cover together form a first supply channel including an enclosed portion of the water supply channel.

In some implementations, the water supply channel includes the first supply channel, a connecting pipe that is connected between the first supply channel and the water supply source, and a water supply pipe that is connected between the first supply channel and the accommodation unit.

In some implementations, the laundry treatment apparatus includes a water discharge channel configured to discharge washing water from the accommodation unit to the outside of the accommodation unit. The water discharge channel includes a first discharge channel formed by the base and the cover; a first water discharge pipe that is connected between the first discharge channel and the accommodation unit; and a second water discharge pipe that is connected between the first discharge channel and the outside of the cabinet.

In some implementations, the second water discharge pipe includes a flexible structure or an elastic material in at least a portion thereof.

In some implementations, the laundry treatment apparatus includes a water discharge channel supported along an exterior of the body and is configured to discharge washing water from the accommodation unit to the outside of the accommodation unit. A discharge pipe is configured to guide washing water supplied from the water discharge channel to the outside of the cabinet. A portion of the water discharge channel that is connected to the discharge pipe includes a flexible structure or an elastic material.

In some implementations, the laundry treatment apparatus includes a water supply opening that is provided at the drawer and is configured to be connected to an end portion of the first supply channel. A through hole is provided at the accommodation unit and is configured to provide a passage for water from the water supply opening. A recovery unit is positioned between the water supply opening and the through hole and is configured to recover moisture discharged from the accommodation unit out of the through hole, and to return the moisture back into the accommodation unit through the through hole.

In some implementations, the recovery unit includes a first recovery part provided at the drawer to be positioned above the through hole and configured to condense steam discharged out of the through hole into condensed water. A second recovery part is positioned above the through hole and is configured to guide the condensed water falling from the first recovery part back down into the through hole.

In some implementations, the second recovery part includes a recovery body protruding toward the first recovery part from an upper surface of the accommodation unit, the recovery body defining a body through hole that corresponds to the through hole. The first recovery part is configured to protrude toward the second recovery part from an upper surface of the drawer.

In some implementations, the laundry treatment apparatus includes a reception recess formed at an upper surface of the accommodation unit and configured to be concave and having a diameter larger than a diameter of the through hole. A body flange protrudes from an outer surface of the recovery body and is configured to contact an inner surface of the reception recess. A flange through hole is formed through the body flange and is configured to provide a passage for condensed water to fall from the body flange into the reception recess. A recovery hole is configured to guide condensed water from the reception recess into the through hole. The first recovery part is configured to have a maximum radial extent that is less than a maximum radial extent of the body flange.

In some implementations, the first recovery part includes a plurality of concentric protrusions from the first recovery part that are spaced apart in a radial direction and that define a plurality of walls of the first recovery part. The plurality of concentric protrusions are arranged to define concentric circles about the water supply opening. The plurality of concentric protrusions include a bottom portion having a maximum radial extent that is larger than a maximum radial extent of the body through hole but smaller than a maximum radial extent of the body flange. The concentric protrusion having the smallest radial extent has a smaller radial extent than the maximum radial extent of the body through hole.

In some implementations, the accommodation unit includes a tub provided in the drawer and configured to receive washing water, and a drum rotatably provided in the tub to contain laundry. The drawer includes a water supply opening through which an introduction port and the water supply channel are connected to each other. The tub includes a through hole configured to provide a passage from the water supply opening to the drum, and a tub introduction port configured to provide a passage from the introduction port to the drum.

In some implementations, the laundry treatment apparatus includes an intermediate connecting member between the water supply opening and the through hole and including a flexible structure or an elastic material.

In some implementations, the laundry treatment apparatus includes a door rotatably provided at the tub and configured to open and close the tub introduction port. A sealing body is provided at the door and is configured to be fitted within the tub introduction port. A first protrusion protrudes from the sealing body and is configured to contact an inner surface of the tub introduction port. A second protrusion is vertically positioned above the tub introduction port and protrudes from the sealing body to contact an upper surface of the tub.

In some implementations, the laundry treatment apparatus includes a through hole configured to provide a passage for washing water to be introduced into the accommodation unit. The first supply channel is configured to extend through the drawer and an end portion of the first supply channel is configured to be connected to the through hole.

In some implementations, at least part of the first supply channel includes a flexible structure or an elastic material.

In some implementations, the end portion of the first supply channel that is positioned between the though hole and the drawer includes a flexible structure or an elastic material.

In some implementations, the laundry treatment apparatus includes a support configured to hold the accommodation unit in the drawer in a movable manner.

It is to be understood that both the foregoing general description and the following detailed description are exemplary and explanatory and are intended to provide further explanation of the subject matter as claimed.

DETAILED DESCRIPTION

Hereinafter, a laundry treatment apparatus is described that includes both a first treatment apparatus T and a second treatment apparatus L.

Figure 1:
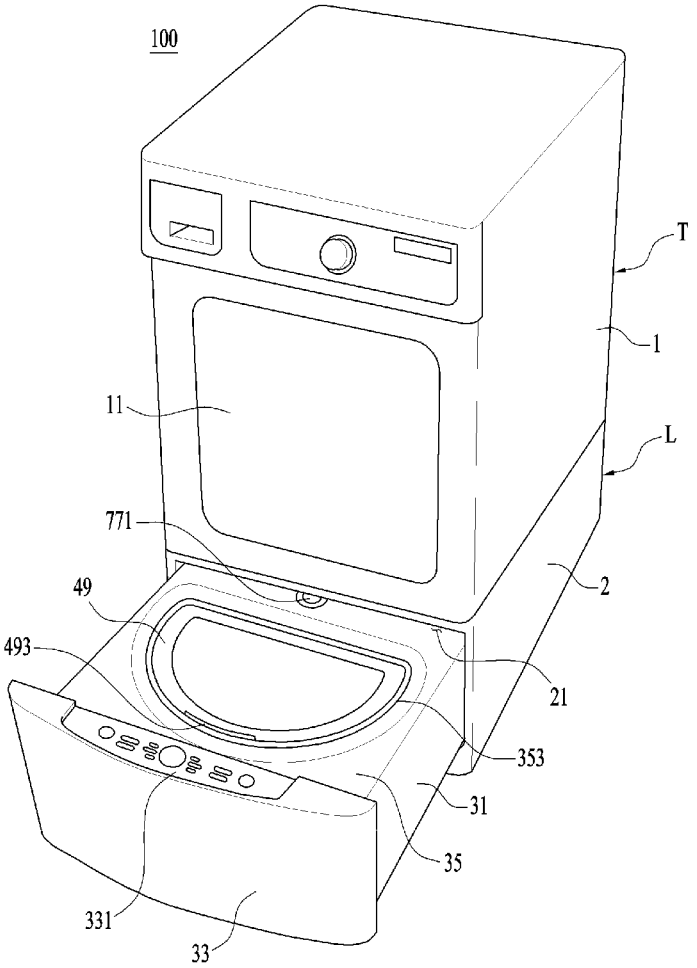
FIG. 1 is a perspective view showing an example of a laundry treatment apparatus.

FIG. 1 illustrates an example laundry treatment apparatus 100. The first treatment apparatus T may include a first treatment apparatus cabinet 1 defining an exterior appearance, a first treatment apparatus tub (not shown) disposed in the first treatment apparatus cabinet 1 to contain washing water therein, a first treatment apparatus drum (not shown) rotatably disposed in the first treatment apparatus tub to contain laundry, a first treatment apparatus water supply unit (not shown) for supplying washing water to the first treatment apparatus tub, and a first treatment apparatus water discharge unit (not shown) for discharging washing water contained in the first treatment apparatus tub to the outside of the first treatment apparatus cabinet 1.

The first treatment apparatus cabinet 1 includes a first treatment apparatus introduction port (not shown) through which laundry is put into the cabinet 1 or taken out of the cabinet 1. The first treatment apparatus introduction port is opened and closed by a first treatment apparatus door 11 hinged to the first treatment apparatus cabinet 1.

The first treatment apparatus tub includes a first treatment apparatus tub introduction port communicating with the first treatment apparatus introduction port, and thus a user can put laundry into the first treatment apparatus drum upon opening of the first treatment apparatus door 11.

When the first treatment apparatus T is designed to also perform a function of drying of laundry, the first treatment apparatus cabinet 1 has to be provided therein with a hot air supply unit (not shown) for supplying hot air to the first treatment apparatus tub.

The hot air supply unit (not shown) may include a circulation duct for circulating air in the first treatment apparatus tub, and a heat exchange unit disposed at the circulation duct to dehumidify and heat the air discharged from the first treatment apparatus tub.

Alternatively, the hot air supply unit (not shown) may also include a discharge duct for discharging air in the first treatment apparatus tub to the outside of the first treatment apparatus cabinet 1, a supply duct for supplying air outside the first treatment apparatus cabinet 1 to the first treatment apparatus tub, and a heat exchange unit disposed at the supply duct.

Unlike the above construction, if the first treatment apparatus T is designed to perform a function of drying of laundry, the first treatment apparatus may not need the first treatment apparatus tub. In this case, the hot air supply unit has to supply hot air to the first treatment apparatus drum provided in the first treatment apparatus cabinet 1.

The second treatment apparatus L incorporated in the laundry treatment apparatus includes a cabinet 2 detachably provided at the first treatment apparatus cabinet 1, a drawer 3 disposed in the cabinet 2 to be retractable therefrom, and an accommodation unit 4-5 disposed in the drawer 3 and serving as a treatment space of laundry. In some examples, the accommodation unit 4-5 may include a tub 4 and a drum 5.

The cabinet 2, which defines an exterior appearance of the second treatment apparatus L, may support the first treatment apparatus cabinet 1. Unlike the cabinet shown in FIG. 1, the cabinet 2 provided at the second treatment apparatus may be detachably provided at an upper surface or a side surface of the first treatment apparatus cabinet 1.

However, since a height of the first treatment apparatus door 11 is increased when the second treatment apparatus L is positioned under the first treatment apparatus T, it is convenient for a user to put laundry into the treatment apparatus or to take laundry out of the treatment apparatus.

The cabinet 2 includes an open surface 21 such that the drawer 3 is withdrawn from the cabinet 2 through the open surface 21 or is accommodated in the cabinet 2. When the second treatment apparatus L is provided at a bottom surface of the first treatment apparatus T, the first treatment apparatus T is supported by an upper panel 25 (see FIG. 2) and the open surface 21 may be disposed at a side (a front side of the first treatment apparatus T) at which the first treatment apparatus door 11 is positioned.

Figure 2:
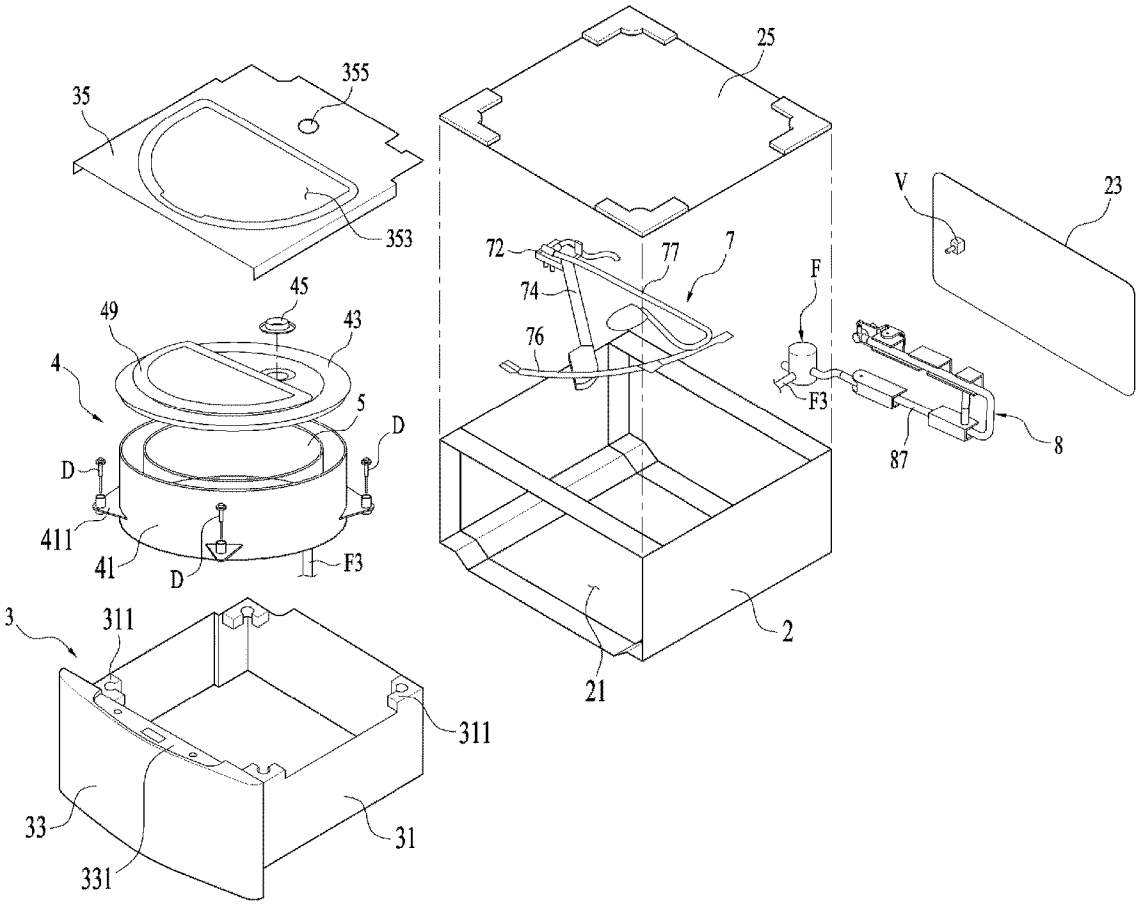
FIG. 2 is an exploded perspective view of an example of a laundry treatment apparatus.

As shown in FIG. 2, the drawer 3 includes a drawer body 31 having an open upper surface, and a drawer cover 35 disposed at the open upper surface of the drawer body 31.

The drawer body 31 may be configured to have a hexahedral shape having a hollow cavity defined therein. The drawer cover 35 is fixed to the drawer body 31 to define the upper surface of the drawer body 31.

The drawer body 31 is provided at a front surface thereof with a drawer panel 33. The drawer panel 33 may include a handle (not shown). In this case, a user can draw the drawer body 31 disposed in the cabinet 2 from the cabinet 2 using the handle.

The drawer panel 33 may include a control panel 331 for controlling operation of the second treatment apparatus L.

The control panel 331 serves to allow a user to input control commands for control of units for supplying washing water to the accommodation unit 4-5 and discharging the washing water from the accommodation unit 4-5, a unit for rotating laundry, units for supplying steam or hot air to laundry and the like.

The control panel 331 may also serve to allow a user to check control commands input by a user and to display an execution state of the control commands input by the user.

The drawer cover 35 may be provided with an introduction opening 353 formed through the drawer cover 35 to communicate the inside of the drawer body 31 with the outside of the drawer body 31, and a water supply opening 355 formed through the drawer cover 35 to guide washing water to the accommodation unit 4-5.

The accommodation unit 4-5 provided in the drawer 3 may include a tub 4 provided in the drawer body 31 to provide a space for containing washing water, and a drum 5 rotatably provided in the tub 4 to contain laundry.

The tub 4 may include a tub body 41 having a space for containing washing water and having an open upper surface, and a tub cover 43 fixed to the upper surface of the tub body 41. The drum 5 may be configured to have a cylindrical shape having an open upper surface.

Figure 3A:
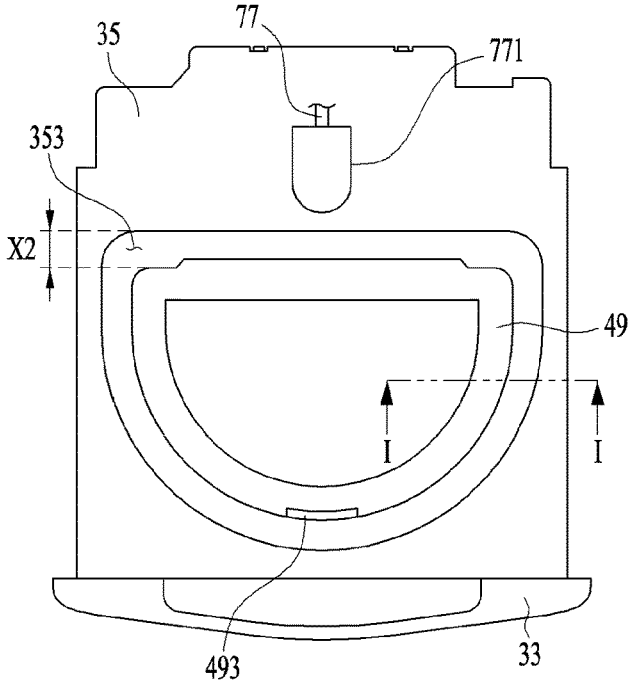
FIGS. 3A and 3B are views showing examples of a drawer, a tub and a door of a laundry treatment apparatus.
Figure 3B:
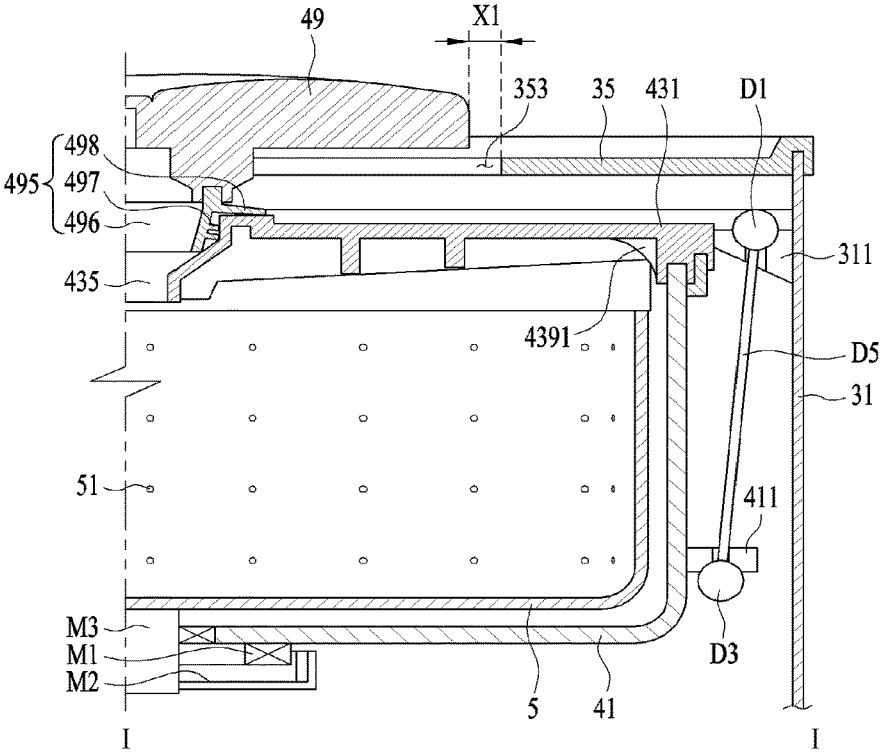

As shown in FIGS. 3A and 3B, the drum 5 may be rotatable in the tub body 41 by means of a driving unit provided outside the tub body 41. The driving unit may include a stator M1 fixed to the tub body 41 to generate a rotating magnetic field, a rotor M2 which is rotated by the rotating magnetic field, and a driving shaft M3 extending through the tub body 41 and connecting the drum 5 to the rotor M2.

The drum 5 includes drum through holes 51 formed at an outer circumferential surface thereof to communicate the inside of the drum 5 with the inside of the tub body 41.

The tub body 41 is held in the drawer body 31 by means of tub supports D.

Each of the tub supports D may include a drawer connecting portion D1, a tub connecting portion D3, and a rod D5 connecting the tub connecting portion D3 to the drawer connecting portion D1.

Here, the drawer body 31 may be provided with a first bracket 311 for supporting the drawer connecting portion D1, and the tub body 41 may be provided at an outer circumferential surface thereof with a second bracket 411 supported by the tub connecting portion D3.

The first bracket 311 may protrude toward the center of the drawer body 31 from an inner surface of the drawer body 31, and the second bracket 411 may protrude toward the inner surface of the drawer body 31 from the outer circumferential surface of the tub body 41.

The tub cover 43 includes a cover body 431 defining an upper surface of the tub body 41, and a tub introduction port 435 formed through the cover body 431 to communicate the introduction opening 353 with the drum 5.

The tub introduction port 435 is provided with a door 49 hinged to the cover body 431.

The door 49 is coupled to the cover body 431 of the tub cover 43 by means of a hinge (not shown). The introduction opening 353 is positioned over the tub introduction port 435. The door 49 or the tub introduction port 435 has a smaller size than that of the introduction opening 353. Accordingly, even though the tub introduction port 435 is positioned below the drawer cover 35, the tub introduction port 435 may be opened and closed by the door 49.

Particularly, the outer circumferential surface of the door may be spaced apart from the inner circumferential surface of the introduction opening 353 by predetermined distances X1 and X2 in order to avoid a problem that the door 49 cannot be opened because of interference between the door 49 and the introduction opening 353 caused by geometric tolerance or positional tolerance.

The door 49 may be provided with a door handle 493 which detachably secures the door 49 to the drawer cover 35 or the cover body 431 of the tub cover 43.

The door 49 may be provided with a sealing unit 495 for mitigating or preventing washing water from leaking through the tub introduction port 435.

The sealing unit 495 may include a sealing body 496 fixed to a lower surface of the door 49, which is fitted in the tub introduction port 435 upon closing the tub introduction port 435, and first and second protrusions 497 and 498 protruding from the sealing body 496.

The first protrusion 497 protrudes toward the inner circumferential surface of the tub introduction port 435 from the outer circumferential surface of the sealing body 496. The first protrusion 497 may have a length sufficient to contact the inner circumferential surface of the tub introduction port 435 when the tub introduction port 435 is closed by the door 49.

The first protrusion 497 may include two or more protrusions provided at the sealing body 496. The two or more first protrusions 497 may be spaced apart from each other by a predetermined interval.

The second protrusion 498 may protrude from the outer circumferential surface of the sealing body 496 so as to close the tub introduction port 435 when the tub introduction port 435 is closed by the door 49. In other words, the second protrusion 498 must have a length sufficient to contact the upper surface of the cover body 431 when the tub introduction port 435 is closed by the door 49.

Although the sealing unit 495 may be made of any materials so long as it can seal the tub introduction port 435 when the tub introduction port 435 is closed by the door 49, as an example, the sealing unit 495 may made of an elastic material such as rubber.

Figure 4A:
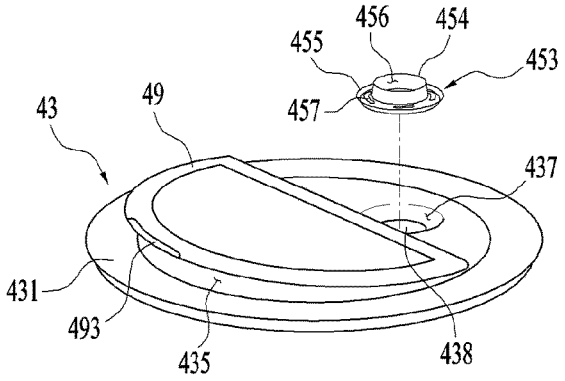
FIGS. 4A, 4B, and 4C are views showing examples of a tub cover of a laundry treatment apparatus.
Figure 4B:
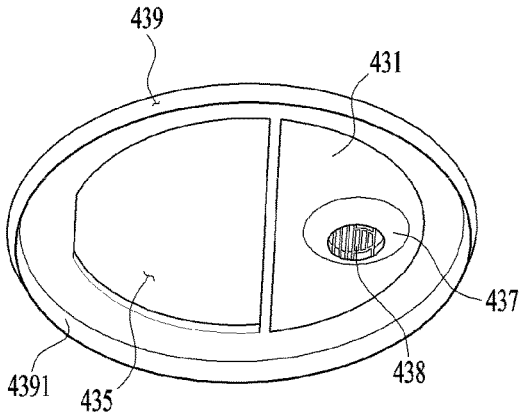
Figure 4C:
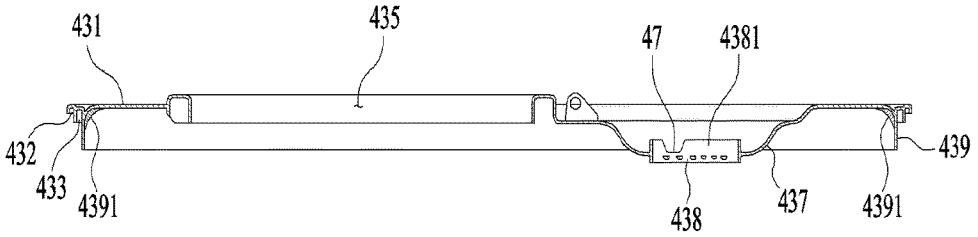

As shown in FIGS. 4A, 4B, and 4C, the cover body 431, which defines the upper surface of the tub body 41, includes a fitting rib 439 fitted in the inner circumferential surface of the tub body 41. The fitting rib 439 may be provided with an inclined portion 4391 for guiding washing water in the tub body 41 into the drum 5.

The drum 5 disposed in the tub body 41 is configured to have a cylindrical shape having an open upper surface. The drum 5 includes drum through holes 51 which are formed at an outer circumferential surface thereof to communicate the inside of the drum 5 with the inside of the tub body 41.

In this example, when the drum 5 rotates, washing water contained in the tub body 41 may rise to the tub cover 43 from the bottom surface of the tub body 41 while rotating along the inner circumferential surface of the tub body 41. At this time, the inclined portion 4391 serves to guide washing water having moved to the tub cover 43 from the bottom surface of the tub body 41, toward the upper surface of the drum 5.

When the washing water is again supplied to the drum 5 through the upper surface of the drum 5, washing water can strike laundry contained in the drum 5. Consequently, the laundry treatment apparatus can improve washing performance by virtue of the inclined portion 4391.

The cover body 431 of the tub cover 43 includes a through hole 438 which is disposed under the water supply opening 355 formed through the drawer cover 35 to guide washing water introduced to the water supply opening 355 to the drum 5.

Since the tub 4 is fixedly disposed in the drawer 3, a position of the through hole 438 that passes through the tub cover 43 is theoretically considered to be fixed under the water supply opening 355 that passes through drawer cover 35 (it is considered that significant relative movement between the through hole and the water supply hole does not occur). Accordingly, it is also possible to supply washing water to the tub 4 through the water supply opening 355 and through a connection to the through hole 438. The connection between the through hole 438 and the water supply opening 355, may have a flexible hose or a bellows hose or may be made of an elastic material.

In some cases, the connection between the through hole 438 and the water supply opening 355 may be a separate intermediate connecting member, such as a pipe. In such cases, the water supply opening 355 may be configured to connect with a water supply pipe 77 that provides water to the tub 4. As such, water may be supplied from the water supply pipe 77 through the water supply opening 355 in the drawer cover 35, through the intermediate connecting member, and through the tub cover 43 via the through hole 438.

In some cases, there may be no separate intermediate connecting member, and instead the connection between the through hole 438 and the water supply opening 355 may be part of the water supply pipe 77 itself. For example, the water supply pipe 77 may be configured with an end portion that extends into the inside of the drawer through the water supply opening 355 and is directly connected to the through hole 438 of the tub cover 43.

In this case, the water supply pipe 77 may have an end portion that is an elastic or flexible structure in at least a portion thereof. The end portion of the water supply pipe 77, which has the flexible or elastic structure, may be positioned between the through hole 438 and the drawer cover 35 (the upper surface of the drawer).

In some scenarios, the connection between the through hole 438 and the water supply opening 355 may vibrate significantly when vibration generated during rotation of the drum 5 is transmitted to the tub body 41. In this case, problems may arise with the durability of the connection becoming deteriorated such that the laundry treatment apparatus may be configured with a structure for attenuating vibration of the connection. Alternatively, in some examples, washing water may be supplied to the tub 4 by positioning the through hole 438 under the water supply opening 355 without using a connection between the through hole 438 and the water supply opening 355.

In such cases in which there is no physical connection between the through hole 438 and the water supply opening 355, when hot water is supplied to the tub body 41 or steam is supplied to the tub body 41 from a steam generation device (not shown), there may arise a problem that moisture (water, mist, steam, etc.) in the tub body 41 is discharged into the cabinet 2 through an open gap formed between the through hole 438 and the water supply opening 355.

Specifically, when moisture or heat in the tub body 41 is discharged in to the cabinet 2 through the through hole 438, washing performance may be deteriorated and devices (electronic devices) disposed in the cabinet 2 may fail or corrode. Accordingly, in cases where there is no physical connection between the through hole 438 and the water supply opening 355, the laundry treatment apparatus may further include a recovery unit for minimizing moisture that is discharged from the tub body 41 into the cabinet 2 through the through hole 438.

Figure 5A:
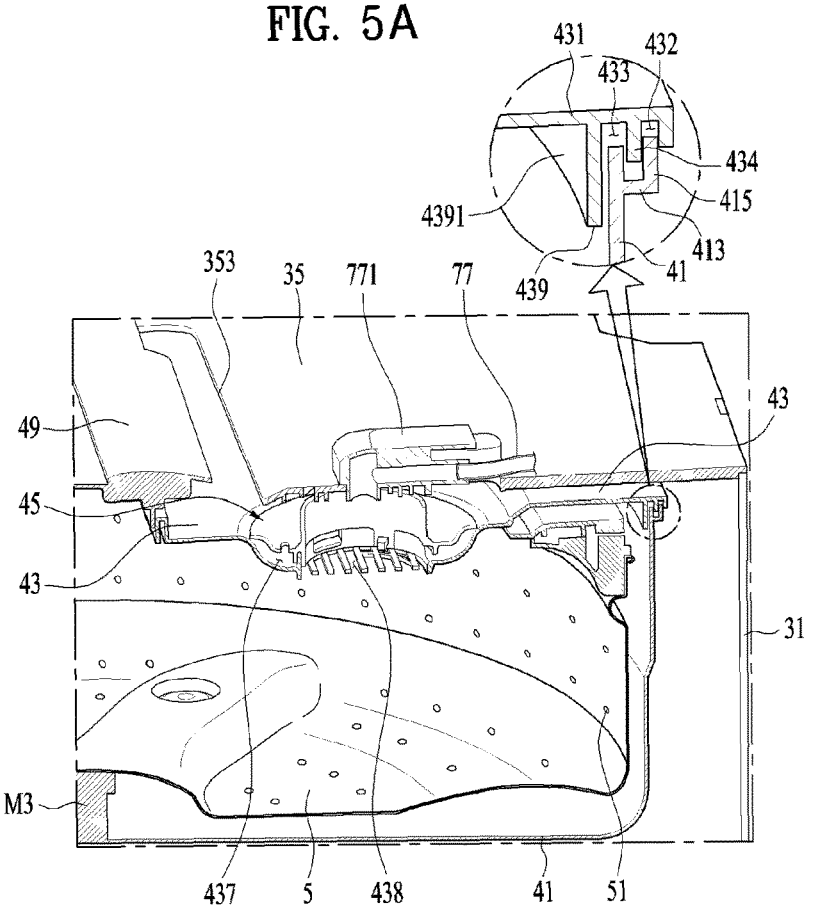
FIGS. 5A and 5B are views showing examples of a recovery unit of a laundry treatment apparatus.
Figure 5B:
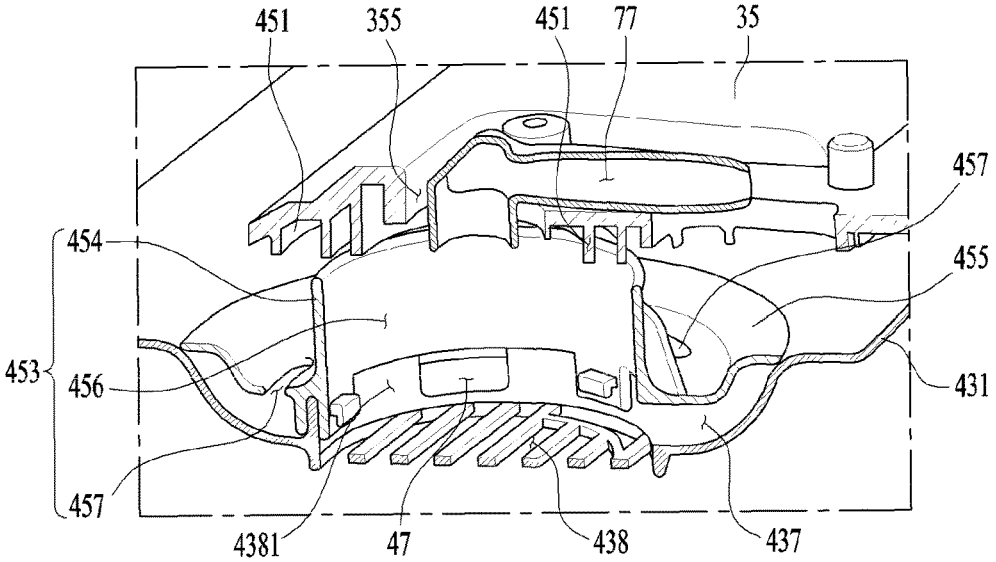

As shown in FIGS. 5A and 5B, the recovery unit 45 incorporated in the laundry treatment apparatus may include a first recovery part 451 provided at the drawer cover 35 and contacting moisture discharged from the through hole 438, and a second recovery part 453 for guiding moisture supplied from the first recovery part 451 to the through hole 438.

The second recovery part 453 may include a recovery body 454 protruding toward the first recovery part 451 from the upper surface of the tub cover 43, and a body through hole 456 formed through the recovery body 454 and communicating with the through hole 438.

The first recovery part 451 may be configured to have any shape so long as it can guide moisture discharged from the through hole 438 to the second recovery part 453.

In some implementations, the first recovery part 451 may be configured into a flat or curved board shape protruding toward the second recovery part 453 from the drawer cover 35. The first recovery part 451 may be configured to have a plurality of concentric protrusions from the first recovery part 451 that are spaced apart in a radial direction and that define a plurality of walls of the first recovery part 451. For example, the recovery part 451 may be configured into a hollow bar shape having an open surface facing the second recovery part 453.

When the first recovery part 451 is configured into the hollow bar shape, the hollow bar may be variously configured. FIGS. 5A and 5B illustrate examples in which the hollow bar is configured into a cylindrical shape.

When the first recovery part 451 is configured into the flat board, the first recovery part 451 may be positioned in the body through hole 456.

In other words, when the first recovery part 451 includes a plurality of boards, the plurality of boards may be positioned in a space which is defined by projection of the through hole 456 to the drawer cover 35 (through hole projection space) in order to supply moisture (water or condensed water) falls toward the second recovery part 453 from the plurality of boards to the through hole 438 through the body through hole 456.

Meanwhile, when the first recovery part 451 includes a plurality of hollow bars, the hollow bars may be positioned in the through hole projection space.

Specifically, when the plurality of hollow bars are arranged to have the same center, the hollow bar having the largest surface area has to be positioned in the through hole projection space. However, the plurality of hollow bars are not arranged to have the same center, the space defined by the plurality of hollow bars has to be positioned in the through hole projection space.

The first recovery part 451 may be configured so as to not interfere with the water supply opening 355 regardless of the shaped of the first recovery part 451. Furthermore, the free ends of the first recovery part 451 may be configured so as to not interfere with the free end of the recovery body 454.

This prevents a problem that the first recovery part 451 collides with the recovery body 454 owing to vibration transmitted to the tub body 41 during rotation of the drum 5 and thus the first recovery part 451 or the second recovery part 453 is broken.

The first recovery part 451 may be made of any materials so long as the first recovery part 451 is constituted by means for mitigating or preventing water discharged from the tub 4 from spreading in the drawer 3 (for guiding water discharged from the tub 4 to the second recovery part).

When the first recovery part 451 is constituted by means for condensing moisture discharged from the tub 4 (exchanging heat with moisture discharged from the tub 4) and guiding the condensed water to the second recovery part, the first recovery part 451 may be made of a metal material. In this case, the second recovery part 453 may be made of an elastic material.

The recovery unit 45 may further include the following components in order to increase recovered amount and condensed amount of moisture.

Specifically, the tub cover 43 may further include a reception recess 437 formed at the cover body 431 to be concave and at which the through hole 438 is positioned. The second recovery part 453 may further include a body flange 455 protruding from an outer surface of the recovery body 454 and positioned over the reception recess 437, and a flange through hole 457 formed through the body flange 455.

Here, the first recovery part 451 may be positioned in a space which is defined by projection of the body flange 455 to the drawer cover 35 (flange projection space).

In other words, when the first recovery part 451 is constituted by a board, the first recovery part 451 may protrude toward the recovery body 454 from the drawer cover 35 such that the first recovery part 451 is positioned in the flange projection space.

Meanwhile, when the first recovery part 451 is constituted by a plurality of hollow bars, the plurality of hollow bars may be positioned in the flange projection space.

If the plurality of hollow bars are arranged so as not to have the same center, it is no problem that a range defined by connection of hollow bars positioned at the periphery is positioned in the flange projection space.

However, when the plurality of hollow bars are constituted by cylinders having the same center, the hollow bar having the greatest diameter may be positioned in the flange projection space positioned outside the through hole projection space and the hollow bar having the smallest diameter may be positioned in the through hole projection space.

If the plurality of hollow bars have the same center but do not have the cylindrical shape, the hollow bar having the greatest surface area may be positioned in the flange projection space and the hollow bar having the smallest surface area may be positioned in the through hole projection space.

When the first recovery part 451 is constituted by a plurality of hollow bars having the same center, the centers of the respective hollow bars may be positioned at the water supply opening 355. In this case, distances between the respective hollow bars may be regular or irregular.

Since the first recovery part 451 is held by the drawer cover 35 and the drawer cover 35 may exchange heat with outside air (e.g., in a continuous manner), the surface temperature of the first recovery part 451 can be maintained to be lower than the temperature of air discharged from the through hole 438.

Furthermore, when the first recovery part 451 is provided near the water supply opening 355, the first recovery part 451 may further decrease in surface temperature by directly exchanging heat with cool water supplied through the water supply opening 355 or outside air introduced through an area around the water supply opening 355, thus improving cooling performance of the first recovery part 451.

The recovery unit 45 has to further include a recovery hole 47 for guiding moisture introduced into the reception recess 437 through the flange through hole 457 to the through hole 438.

When the reception recess 437 is provided with a support pipe 4381 that protrudes toward the first recovery part 451 to support a lower surface of the recovery body 454, the recovery hole 47 may be formed through the support pipe 4381. However, when the recovery body 454 is directly fixed to a circumferential surface of the through hole 438, the recovery hole 47 has to be formed through the recovery body 454.

In any case, the inner surface of the reception recess 437 may be inclined such that condensed water in the reception recess 437 flows toward the recovery hole 47.

Although the laundry treatment apparatus has been described in connection with examples in which the recovery unit 45 includes both the first recovery part 451 and the second recovery part 453, the recovery unit 45 may include only the first recovery part 451 positioned over the through hole 438.

The reason is because steam discharged from the through hole 438 will be condensed on a surface of the first recovery part 451 and then introduced into the through hole 438 by gravity, and water discharged from the through hole 438 will come into contact with the surface of the first recovery part 451 and then will be introduced into the through hole 438 by gravity.

For coupling of the tub cover 43 to the tub body 41, the tub cover 43 may further include a first fitting groove 432 having a larger diameter than that of the fitting rib 439, and a second fitting groove 433 positioned between the first fitting groove 432 and the fitting rib 439.

In this case, the upper end of the tub body 41 may be fitted in the second fitting groove 433 and a fitting member 413-415 provided at an outer circumferential surface of the tub body 41 may be fitted in the first fitting groove 432.

The fitting member may include a first fitting member body 413 protruding from the outer circumferential surface of the tub body 41 outward, and a second fitting member body 415 protruding toward the tub cover 43 from the first body 413 and fitted in the second fitting groove 433.

In addition, the tub cover 43 may further include a fitting groove partition 434 for discriminating the first fitting groove 432 from the second fitting groove 433. The fitting groove partition 434 is fitted in a groove formed between the second fitting member body 415 and the outer circumferential surface of the tub body 41.

In some examples, as a consequence of the above coupling structure between the tub body 41 and the tub cover 43, the laundry treatment apparatus can reduce or minimize washing water or steam outwardly leaking through between the tub body 41 and the tub cover 43 from the tub body 41.

Unlike the above structure, the fitting member 414-415 may be positioned in the tub body 41. In other words, the second fitting member body 415 may have a smaller diameter than that of the tub body 41.

In this case, the second fitting member body 415 may be fitted in the second fitting groove 433 and the upper end of the tub body 41 may be fitted in the first fitting groove 432.

The laundry treatment apparatus, which is constructed as described above, supplies washing water into the tub body 41 through a water supply channel, and discharges the washing water in the tub body 41 to the outside of the cabinet 2 through a water discharge channel.

Figure 6:
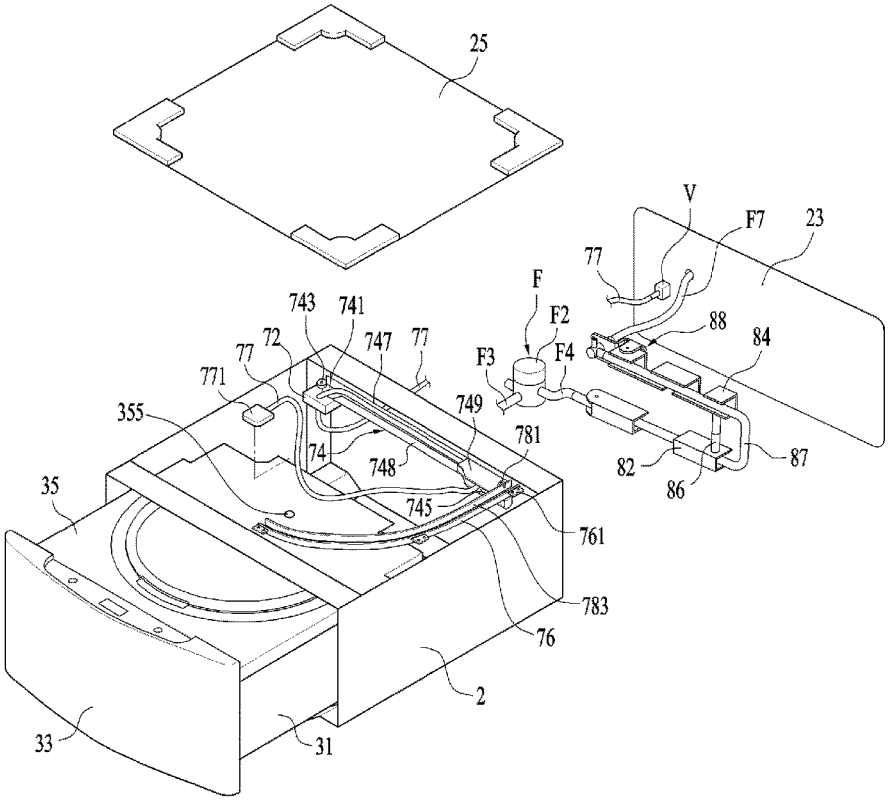
FIG. 6 is a view showing an example of a guider and a water discharge guider of a laundry treatment apparatus.

As shown in FIG. 6, the water discharge channel has to be constructed to connect a discharge unit F fixed to the drawer 3 to a rear panel 23, and the water supply channel has to be constructed to connect the water supply opening 355 provided at the drawer 3 to a water supply source positioned outside the cabinet 2 through a supply unit V.

Accordingly, if the water supply channel and the water discharge channel are merely constituted by a water supply pipe 77 (capable of being fixed to the water supply opening 355 by a holder 771) connecting the supply unit V to the water supply opening 355 and a water discharge pipe 87 connecting the water discharge unit F to the rear panel 23, respectively, and means for guiding movement of the water supply pipe 77 and the water discharge pipe 87 is not provided in the cabinet 2, there is a risk of the water supply pipe 77 or the water discharge pipe 87 becoming entangled or broken when the drawer 3 is withdrawn from the cabinet 2 or is pushed into the cabinet 2.

In order to avoid such risk, the laundry treatment apparatus 100 further include a guider provided in the cabinet 2 to guide movement of the water supply channel.

The discharge unit F may be constituted by a pump fixed to the drawer body 31. The pump may include a housing F1 fixed to the drawer body 31 to contain washing water, and a motor F2 for rotating an impeller disposed in the housing F1.

The housing F1 is connected to the tub body via a housing introduction part F3 and connected to the water discharge pipe 87 via a first housing water discharge part F4. Accordingly, when the impeller is rotated by the motor F2, washing water contained in the tub body 41 is introduced into the housing F1 through the housing introduction part F3 and then introduced into the water discharge pipe 87 through the first discharge part F4.

The supply unit V may be constituted by a valve connected to the water supply source. However, if there are first and second water supply sources provided outside of the cabinet 2 to supply washing water of different temperatures, the supply unit V according to present invention will be constituted by first and second valves connected to the respective water supply sources.

The guider 7 constituting the laundry treatment apparatus may include a body 74 rotatably provided in the cabinet to support the water supply pipe 77, and a body guider 76 secured in the cabinet 2 to guide movement of the body 74.

The body 74 may be constructed to be directly secured to an inner surface of the cabinet 2, and may also be constructed to be rotatably supported by a support 72 fixed to the cabinet 2 as shown in FIG. 6.

Although the support 72 may be fixed at any position on the inner surface of the cabinet 2, the support 72 should be constructed so as not to interfere with the drawer 3 when the drawer 3 is pushed into the cabinet 2.

The body 74 may include a bar-shaped base 741, a base rotating shaft 743 for rotatably connecting the base 741 to the support 72, and an accommodation space 745 provided at the base 741 to accommodate the water supply pipe 77.

The accommodation space 745 is defined by a first flange 747 and a second flange 748 which are longitudinally formed at both sides of the base 741 and protrude therefrom to face each other.

The water supply pipe 77 disposed in the accommodation space 745 cannot be separated from the accommodation space 745 by means of a cover 749. FIG. 6 illustrates an example in which the cover 749 is constructed to connect the free end of the first flange 747 to the free end of the second flange 748.

The body guider 76 may be constructed into any shape so long as it can support the base 741 when the body 74 rotates about the base rotating shaft 743. However, when the base 741 is constructed into a bar shape, the free end of the base 741 moves along an arcuate orbit and thus the body guider 76 may also be constructed into an arcuate shape.

The body guider 76 may be positioned under the body 74 to support the base 741, and may also be positioned over the body 74 or at the same level as that of the body 74.

If the guider 76 is positioned to support the lower surface of the base 741, there is no need for a guider holder unit 781-783. Meanwhile, if the body guider 76 is positioned over the body 74 or at the same level as that of the body 74, the guider 7 may be provided with the guider holder unit 781-783.

When the body guider 76 is constructed to support the lower surface of the base 741, the body guider 76 should not interfere with the drawer 3 when the drawer 3 is pushed into the cabinet 2. To this end, the body guider 76 may be constructed to extend toward the lower surface of the base 741 from the support 72 and to have an arcuate shape.

When the body guider is positioned over the body 74 or at the same level as that of the body 74, the body guider 76 may be fixed to any position on the inner surface of the cabinet 2 so long as it does not interfere with movement of the drawer 3.

FIG. 6 illustrates an example in which the body guider 76 is fixed to an upper panel 25 of the cabinet 2. In this case, the body guider 76 may be further provided with an attaching flange 761 which is attached to the upper panel 25 by means of fastening elements (such as screws) for fastening the body guider 6 to the upper panel 25.

The guider holder unit, which enables the body 74 to be rotated by guide of the body guider 76, may include a first guider holder 781 provided at the body 74, and a second guider holder 783 provided at the body guider 76 in a longitudinal direction and to which the first guider holder 781 is movably coupled.

When the body guider 76 is constructed to support the free end of the body 74, the first guider holder 781 may be embodied as a hook protruding from the cover 749.

In this case, the second guider holder 783 may be constituted by a protruding rail that is formed at the body guider 76 in a longitudinal direction, and may also be constituted by a groove that is formed at the body guider 76 in a longitudinal direction by bending the body guider 76.

The body guider 76 may be constructed to support a portion other than the free end of the body 74. In this case, the first guider holder 781 may be provided at at least one of the first flange 747 and the second flange 748, and the second guider holder 783 may be longitudinally formed along the body guider 76 disposed over the body 74 to support the first guider holder 781.

Since the body 74 constituting the guider 7 is rotatably provided over the drawer cover 35 and the body guider 76 is positioned over the body 74 or at the same level as that of the body 74, the drawer 3 does not interfere with the guider 7 when the drawer 3 is withdrawn from or pushed into the cabinet 2. As a result, the laundry treatment apparatus can mitigate or prevent the water supply pipe 77 from being entangled with the drawer 3 or from being broken by the drawer 3 when the drawer 3 is withdrawn from or pushed into the cabinet 2.

The water discharge pipe 87 incorporated in the laundry treatment apparatus is supported by a water discharge pipe guider 8.

Figure 7:
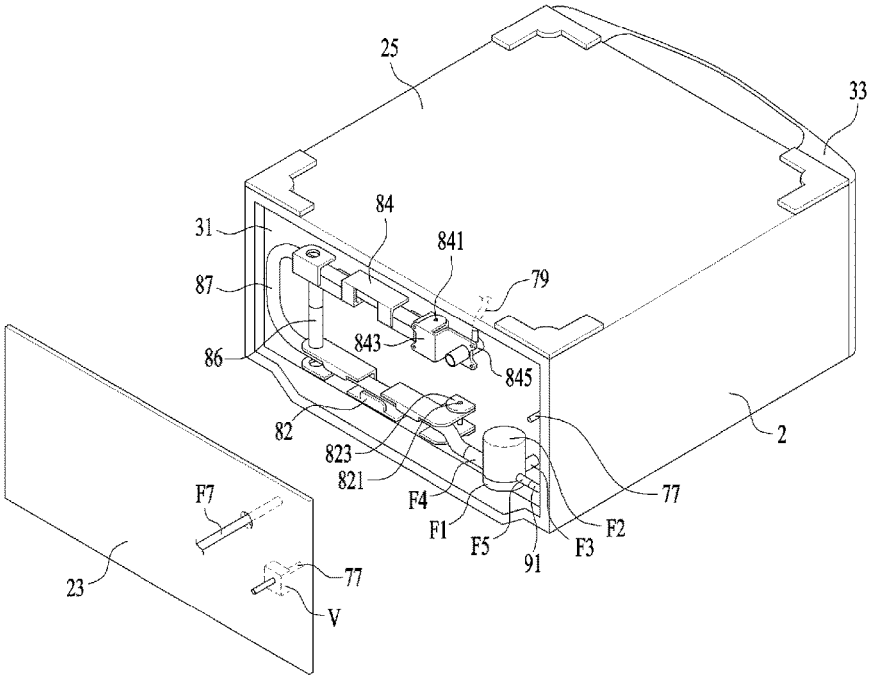
FIG. 7 is a view showing an example of a water discharge guider of a laundry treatment apparatus.

As shown in FIG. 7, the water discharge pipe guider 8 may include a first frame 82 rotatably provided at the drawer 3 to support a portion of the water discharge pipe 87, a second frame 84 rotatably provided at the cabinet 2 to support a portion of the water discharge pipe 87, and a frame rotating shaft 86 rotatably connecting the first frame 82 to the second frame 84.

The first frame 82 is rotatably coupled to the drawer 3 by a first shaft 821 coupled to a first frame support 823 fixed to the rear surface of the drawer body 31, and the second frame 84 is rotatably coupled to the cabinet 2 by a second shaft 841 coupled to a second frame support 843 fixed to the rear panel 23 of the cabinet 2.

The free end of the first frame 82 and the free end of the second frame 84 are connected to each other through the frame rotating shaft 86.

The second frame support 843 is provided with a discharge pipe 845 extending through the rear panel 23. The discharge pipe 845 may be connected to a sewage outlet through a drainpipe F7. In this case, the discharge pipe 87 is intended to connect a first housing discharge part F4 to the discharge pipe 845 and is supported by the first frame 82 and the second frame 84.

Figure 8:
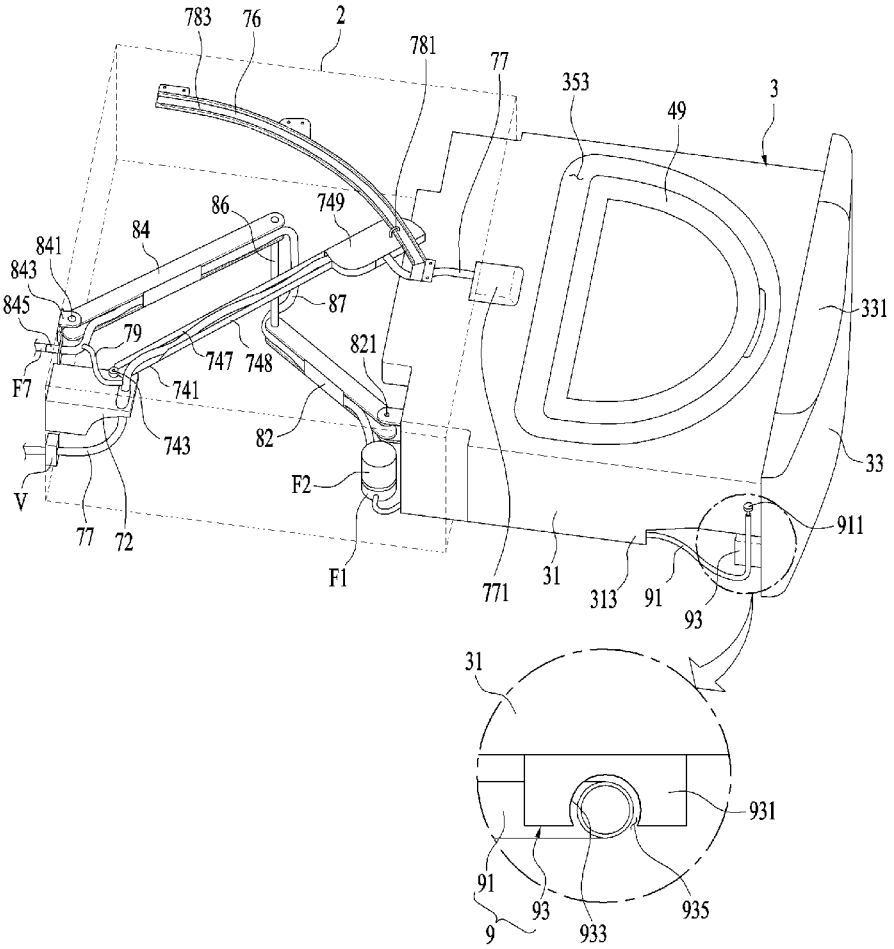
FIG. 8 is a view showing an example of an operation of a guider of a laundry treatment apparatus.

As shown in FIG. 8, the drawer 3 is withdrawn from the cabinet 2, the second frame 84 is rotated clockwise about the second shaft 841 and the first frame 82 is rotated counterclockwise about the first shaft 821 while maintaining the state of being connected to the second frame 84 through the frame rotating shaft 86. As a result, the laundry treatment apparatus can mitigate or prevent from the water discharge pipe 87 from being entangled with the drawer 3 or the water supply pipe 77 when the drawer 3 is withdrawn from or pushed into the cabinet 2.

In the laundry treatment apparatus having only the above structure, washing water in the tub body 41 may be discharged by the siphon effect upon activation of the motor F2.

When the siphon effect occurs, it may be advantageous if washing water does not remain in the tub body 41 or the water discharge pipe 87. However, foul odors generated from the sewage outlet may be introduced into the tub body 41 through the drainpipe F7. Furthermore, when washing water is supplied to the tub body 41 before completion of discharge of washing water, there is a risk of even washing water introduced to the tub body 41 becoming discharged.

Accordingly, the laundry treatment apparatus may further include a communication pipe 79 for mitigating or preventing the siphon effect by the water discharge pipe 87. The communication pipe 79 may be constructed to connect the water supply pipe 77 to the water supply pipe 87.

In order to ensure that washing water supplied to the tub body 41 is not discharged to the outside of the tub body 41 through the water discharge pipe 87 even though the motor F2 provided at the discharge unit F is not operated, the discharge pipe 845 has to be positioned at a higher level than the maximum level of washing water contained in the tub body 41.

Here, the water discharge pipe 87 extends to the discharge pipe 845 from the housing F1 of the pump positioned at a level lower than the discharge pipe 845. When operation of the impeller is halted by deactivation of the motor F2, air in the drawer 3 is introduced into the water discharge pipe 87 through the communication pipe 79, thus blocking the siphon effect. Consequently, the washing water will remain in the water discharge pipe 87.

When washing water remains in the water discharge pipe 87, it is possible to mitigate or prevent introduction of foul odor generated from a sewage outlet into the tub body 41 through the water discharge pipe 87 but there is a risk of the water discharge pipe 87 rupturing upon freezing in winter. Accordingly, there is a need to discharge even washing water in the water discharge pipe 87. To this end, the laundry treatment apparatus may include a residual water discharge unit 9 if desired.

The residual water discharge unit 9 may include a residual water discharge tube 91 which communicates with the housing F1 of the discharge unit F and is exposed to the outside of the cabinet 2 when the drawer 3 is withdrawn from the cabinet 2.

A fixed end of the residual water discharge tube 91 may communicate with the housing F1 through the second discharge part F5, and a free end of the residual water pipe 91 may be detachably held by the drawer body 31. The free end of the residual water discharge tube 91 is provided with a water discharge pipe opening and closing device 911 for opening and closing the residual water discharge tube 91.

In order to hold the free end of the residual water discharge tube 91 on the drawer body 31, the residual water discharge unit 9 may further include a water discharge pipe attachment 93 provided at the drawer body 31.

The water discharge pipe attachment 93 is provided at the drawer body 31 such that it is positioned in the rear of the drawer panel 33 (near the open surface 21).

Specifically, the water discharge pipe attachment 93 may include a fixed body 931 fixed to the drawer body 31 to be positioned between the rear surface of the drawer panel 33 and the introduction opening 353, a fixed body through hole 933 formed through the fixed body 931, and an entrance 935 formed at the fixed body 931 such that the fixed body through hole 933 communicates with the outside of the fixed body 931.

The fixed body through hole 933 has a diameter equal to or larger than that of the residual water discharge tube 91, and the entrance 935 has a width smaller than the diameter of the residual water discharge tube 91.

As a result, a user can fit the residual water discharge tube 91 into the fixed body through hole 933 through the entrance 935, or can take the residual water discharge tube 91 out of the fixed body 931.

In order to mitigate or prevent the residual water discharge tube 91 from becoming entangled in the cabinet or interfering with components provided in the cabinet 2 when the drawer 3 is withdrawn from the cabinet 2, the drawer body 31 may further include a water discharge tube support 313 for mitigating or preventing the residual water discharge tube 91 from contacting the inner surface of the cabinet 2. FIG. 8 illustrates an example in which the water discharge tube support 313 is provided at a lower position of the drawer body 31.

Although not shown in the drawings, the laundry treatment apparatus may further include a hot air supply device (not shown) for supplying hot air to the tub 4 to dry laundry contained in the drum 5. The hot air supply device may be provided at any of the first treatment apparatus T and the second treatment apparatus L.

Hereinafter, operation of the laundry treatment apparatus will be described with reference to FIG. 8.

In order to put laundry into the accommodation unit 4-5 provided in the drawer 3, a user has to withdraw the drawer body 31 from the cabinet 2 using the drawer panel 33.

When the drawer body 31 is withdrawn from the cabinet 2, the body 74 is supported by the body guider 76 and is rotated in a drawing direction of the drawer body 31 about the base shaft 743. Accordingly, the laundry treatment apparatus can mitigate or prevent the water supply pipe 77 from breaking when the drawer 3 is withdrawn from the cabinet 2.

When the drawer 3 is withdrawn from the cabinet 2, the second frame 84 is rotated clockwise about the second shaft 841 and the first frame 82 is rotated counterclockwise about the first shaft 821 while maintaining the state of being connected to the second frame 84 through the frame rotating shaft 86. As a result, the laundry treatment apparatus can also mitigate or prevent breakage of the water discharge pipe 87 when the drawer 3 is withdrawn from the cabinet 2.

When the drawer body 31 is withdrawn from the cabinet 2, the introduction opening 353 formed at the drawer cover 35 is exposed to the outside. As a result, a user can put laundry into the drum 5 positioned below the tub introduction port 435 by rotating the door 49 disposed in the introduction opening 353 to open the tub introduction port 435.

When laundry is put into the drum 5, a user closes the tub introduction port 435 by the door 49 and pushes the drawer 3 into the cabinet. At this time, the guider 7 and the water discharge pipe guider 8 mitigate or prevent the water discharge pipe 77 and the water discharge pipe from interfering with the components provided in the cabinet 2, the drawer 3 and the like.

When a user inputs a control command for washing through the control panel 331 in the state in which the drawer 3 is disposed in the cabinet 2, the valve provided at the supply unit V opens the water supply pipe 77.

When washing water supplied from the water supply source is introduced into the water supply pipe 77, the washing water is supplied to the drum 5 through the water supply opening 355 provided at the drawer cover 35 and the through hole 438 formed at the tub cover 43.

Upon completion of supply of the washing water, the driving unit rotates the drum 5. When the drum 5 rotates, washing water in the tub body 41 can rotate in the tub body 41, together with the drum.

When washing water is rotated in the tub body 41 by the drum 5, the washing water in the tub body 41 can move toward the tub cover 43 from the bottom surface of the tub body 41. However, since the tub cover 43 is provided with the inclined portion 4391, the laundry treatment apparatus can again introduce washing water into the drum 5 through the open upper surface of the drum 5.

Upon completion of washing, the control unit discharges washing water contained in the tub body 41.

More specifically, the control unit supplies power to the motor F2 provided at the discharge unit F to transfer washing water in the tub body 41 to the water discharge pipe 87. The washing water introduced into water discharge pipe 87 flows to a sewage outlet through the discharge pipe 845 and the drainpipe F7.

Since the water discharge pipe 87 is connected to the water supply pipe 77 through the communication pipe 79 and the water supply pipe 77 communicates with the drawer body 31 through the water supply opening 355, when the control unit stops supply of power to the motor F2, air is supplied to the water discharge pipe 87, thus eliminating the siphon effect.

Furthermore, since the water discharge pipe 87 is inclined to enable residual water in the water discharge pipe 87 to be moved to the housing F1, almost all of the residual water in the water discharge pipe 87 will be contained in the housing F1 of the discharge unit F.

If washing water is contained in the housing F1, it is possible to mitigate or prevent introduction of foul orders generated from a sewage outlet from being introduced into the tub body 41 through the water discharge channel and to mitigate or prevent breakage of the first water discharge pipe 83 in the case of decrease in outside temperature of the laundry treatment apparatus.

Furthermore, since the residual water discharge tube 91 is connected to the housing F1, even residual water in the housing F1 can be discharged if desired. However, in order to discharge residual water in the housing F1, a user has to withdraw the drawer 3 from the cabinet 2.

Furthermore, when washing water supplied for laundry washing is hot water or steam is supplied to laundry after washing of laundry, moisture (water vapor or steam) supplied into the tub body 41 can be discharged to the outside of the tub body 41 through the through hole 438.

The moisture, which has been discharged to the outside of the tub body 41 through the through hole 438, is condensed on a surface of the first recovery part 451 provided over the through hole 438 and then falls to the secondary recovery part 453. Therefore, the laundry treatment apparatus can minimize leakage of moisture in the tub body 41 into the drawer 3 or the cabinet 2.

Figure 9A:
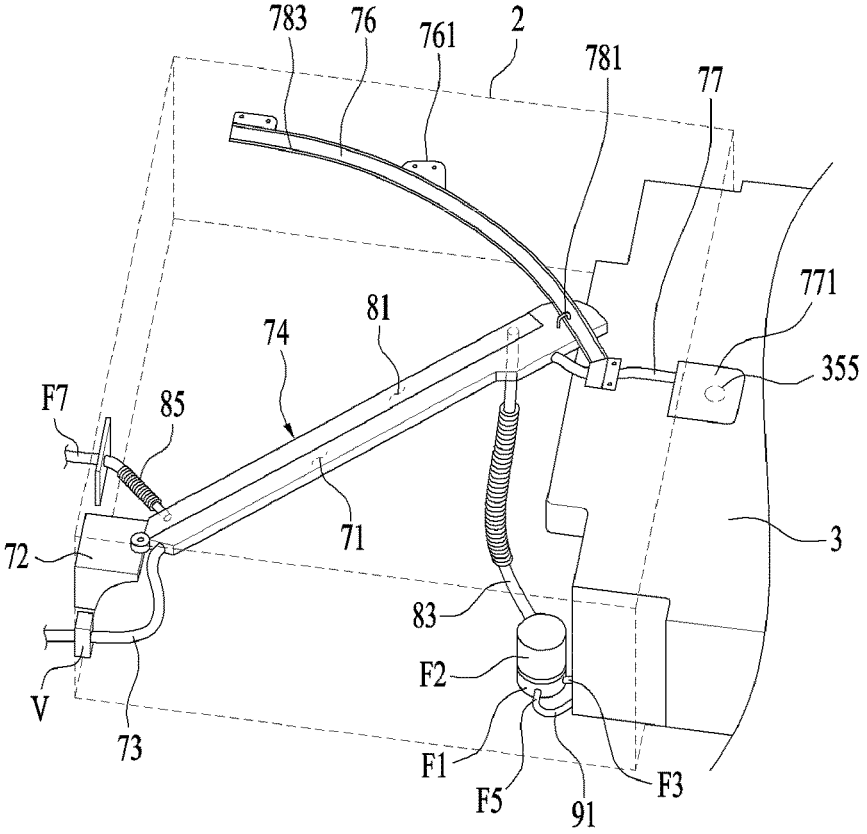
FIGS. 9A, 9B, and 10 are views showing examples of a guider of a laundry treatment apparatus.
Figure 9B:
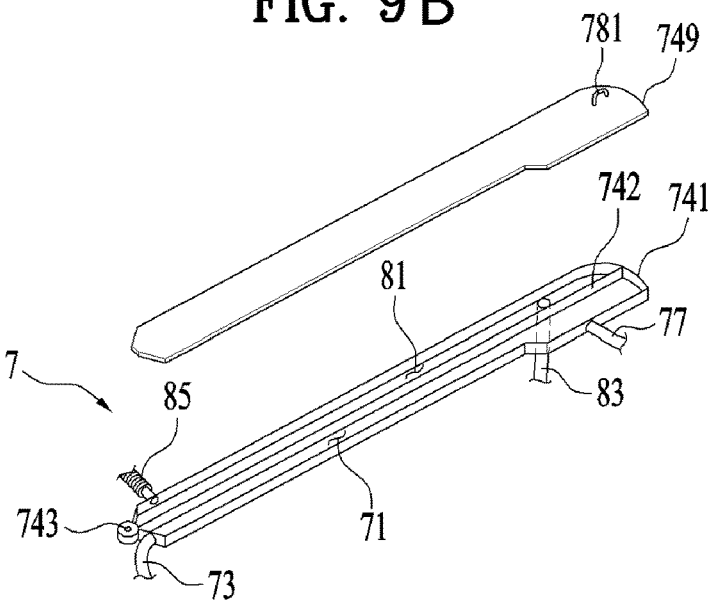

FIGS. 9A and 9B illustrate other examples of the guider 7. The guider 7 according to this example is discriminated from the guider 7 shown in FIG. 8 in that the water supply channel and the water discharge channel are supported by a single guider 7.

The guider 7 according to this example also includes a body 74 which is also rotatably supported by the support 72, and a body guider 76 for guiding movement of the body 74.

The body 74 may include a base rotatably coupled to the support 72 through the base rotating shaft 743, a partition 742 dividing the internal space of the base 741 into a first supply channel 71 and a first discharge channel 81, and a cover 749 coupled to the base 741 to close the first supply channel 71 and the first discharge channel 81.

The body 74 is supported by the body guider 76 through the guider holders 781 and 783. Since the positional relationship between the body 74 and the body guider 76 and position and structure of the guider holders 781 and 783 are the same as described above, detailed description thereof is omitted.

In this example, the water supply channel constituting the laundry treatment apparatus may include a first supply channel 71 provided at the body 74, a connecting pipe 73 connected between the first supply channel 71 and the supply unit V, and a water supply pipe 77 connected between the first supply channel 71 and the water supply opening 355 provided at the drawer. The water supply pipe 77 may be held at the water supply opening 355 by the holder 771 fixed to the drawer 3.

The water discharge channel according to this example may include a first discharge channel 81 provided at the body 74, a first water discharge pipe 83 connected between the first discharge channel 81 and the housing F1 of the discharge unit, and a second drainpipe 85 connected between the first discharge channel 81 and the drainpipe F7.

The second water discharge pipe 85 may be connected to the housing F1 through the first discharge unit F4 provided at the housing F1. The first water discharge pipe 83 and the second water discharge pipe 85 may be made of an elastic material (such as rubber), or may be constructed into a bellows capable of extending and contracting longitudinally.

Figure 10:
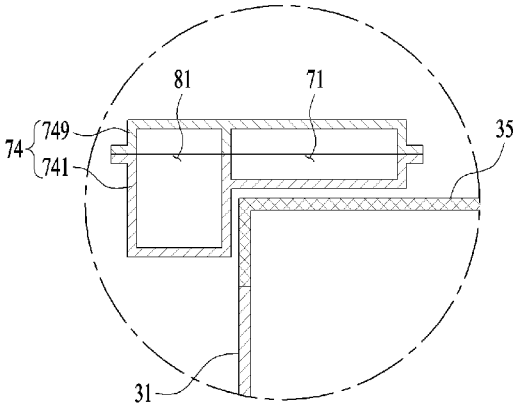

The body 74 according to the example may be configured to have a cross-sectional shape as shown in FIG. 10. FIG. 10 illustrates an example in which the body 74 positioned at an upper portion of the rear surface of the drawer 3 has a cross-sectional shape capable of accommodating an upper edge of the rear surface of the drawer 3. Thanks to such configuration, the laundry treatment apparatus can maximize a volume of the drawer 3 while minimizing a volume of the cabinet 2.

Specifically, the first supply channel 71 may be positioned at an upper portion of the drawer 3 to be parallel to the upper surface of the drawer 3 (the drawer cover 35), and the first discharge channel 81 may be positioned at a rear portion of the drawer 3 to be parallel to the rear surface of the drawer 3.

When the body 74 sags due to gravity or external force (vibration of the drawer), since the area of the body 74 at which the first supply channel 71 is provided may be supported by the upper surface 35 of the drawer, the cross-sectional shape of the body 74 functions to mitigate or prevent deformation or breakage of the guider 6.

When the drawer 3 is fitted in the cabinet 2, the area of the body 74 at which the first discharge channel 81 is provided functions to mitigate or prevent the body 74 from being rotated toward the drawer 3. Accordingly, the above-described cross-sectional shape of the body 74 functions to mitigate or prevent the body 74 from escaping from the set position due to application of external force (vibration of the drawer).

As described above, the laundry treatment apparatus may be detachably coupled to another laundry treatment apparatus to perform both functions of washing and drying of laundry.

Furthermore, the laundry treatment apparatus may be constructed to enable washing water to be easily supplied to or discharged from an accommodation unit retractably provided at a cabinet to accommodate laundry.

In addition, the laundry treatment apparatus may be configured to condense moisture discharged from the accommodation unit and returning the condensed water to the accommodation unit.

Furthermore, the laundry treatment apparatus may be configured to mitigate or prevent washing water from remaining in a discharge unit serving to discharge washing water contained in an accommodation unit.

It will be apparent to those skilled in the art that various modifications and variations can be made without departing from the spirit or scope of the disclosure. Thus, it is intended that the present disclosure covers modifications and variations that come within the scope of the appended claims and their equivalents.

What is claimed is:

1. A laundry treatment apparatus comprising:

a cabinet;

a drawer retractably provided in the cabinet;

an accommodation unit disposed in the drawer and defining a space configured to receive washing water;

a water supply channel connected to a water supply source and configured to supply washing water to the accommodation unit;

a body along which a water supply channel is provided, the body having a first end that is rotatably coupled to the cabinet and a second end that is a free end of the body and is arranged between an upper surface of the cabinet and an upper surface of the drawer in a state in which the drawer is in a closed position; and a body guider fixed to the cabinet to be positioned above the upper surface of the drawer in the state in which the drawer is in the closed position, and configured to guide a rotational movement of the body, wherein the body is positioned below the body guider and above the upper surface of the drawer in the state in which the drawer is in the closed position, and the body is connected to the body guider to be movable along the body guider as the drawer moves.

2. The laundry treatment apparatus according to claim 1, wherein the water supply channel is formed as an internal channel inside the body.

3. The laundry treatment apparatus according to claim 1, wherein the water supply channel is formed as an external water pipe supported by the body.

4. The laundry treatment apparatus according to claim 1, wherein the body guider is configured to provide upward directional support for the body.

5. The laundry treatment apparatus according to claim 1, further comprising:

a first guider holder provided at the body; and a second guider holder provided along the body guider and along which the first guider holder is movably supported.

6. The laundry treatment apparatus according to claim 5, wherein the second guider holder comprises at least one of:

a protruding rail that is formed along the body guider, or a groove that is formed along the body guider, and wherein the first guider holder comprises a hook that is configured to protrude from the body and is configured to be movably coupled to the second guider holder.

7. The laundry treatment apparatus according to claim 1, further comprising:

a water discharge channel configured to discharge washing water from the accommodation unit to the outside of the cabinet;

a first frame rotatably provided at the drawer and configured to support the water discharge channel;

a second frame rotatably provided at the cabinet and configured to support the water discharge channel; and a frame rotating shaft configured to rotatably connect the first frame to the second frame.

8. The laundry treatment apparatus according to claim 7, wherein:

a first end of the first frame is rotatably connected to the drawer, a first end of the second frame is rotatably connected to the cabinet, and the frame rotating shaft rotatably connects a second end of the first frame with a second end of the second frame.

9. The laundry treatment apparatus according to claim 1, further comprising a water discharge channel provided along the body and configured to discharge washing water from the accommodation unit to the outside of the accommodation unit.

10. The laundry treatment apparatus according to claim 9, wherein the water discharge channel is formed as an internal channel inside the body.

11. The laundry treatment apparatus according to claim 9, wherein the water discharge channel is formed as an external water pipe supported by the body.

12. The laundry treatment apparatus according to claim 9, wherein the body is configured to have a recessed portion that is configured to accommodate an upper edge of a rear surface of the drawer when the drawer in the closed position.

13. The laundry treatment apparatus according to claim 12, wherein the body defines a washing water channel that is divided into a first supply channel and a first discharge channel by a partition.

14. The laundry treatment apparatus according to claim 1, further comprising a water discharge channel configured to discharge washing water from the accommodation unit to the outside of the accommodation unit, wherein the water supply channel comprises a first supply channel provided along an interior of the body, a connecting pipe connected between the first supply channel and the water supply source, and a water supply pipe connected between the first supply channel and the accommodation unit, and wherein the water discharge channel is supported along an exterior of the body.

15. The laundry treatment apparatus according to claim 1, further comprising a water discharge channel configured to discharge washing water from the accommodation unit to the outside of the accommodation unit, wherein the water supply channel is supported along an exterior of the body, and wherein the water discharge channel comprises a first discharge channel provided along an interior of the body, a first water discharge pipe connected between the first discharge channel and the accommodation unit, and a second water discharge pipe connected between the first discharge channel and the outside of the cabinet.

16. The laundry treatment apparatus according to claim 1, wherein the body comprises:

a base rotatably coupled to the cabinet; and a cover coupled to the base such that the base and the cover together form a first supply channel comprising an enclosed portion of the water supply channel.

17. The laundry treatment apparatus according to claim 16, wherein the water supply channel comprises the first supply channel, a connecting pipe connected between the first supply channel and the water supply source, and a water supply pipe connected between the first supply channel and the accommodation unit.

18. The laundry treatment apparatus according to claim 17, further comprising a water discharge channel configured to discharge washing water from the accommodation unit to the outside of the accommodation unit, wherein the water discharge channel comprises:

a first discharge channel formed by the base and the cover;

a first water discharge pipe connected between the first discharge channel and the accommodation unit; and a second water discharge pipe connected between the first discharge channel and the outside of the cabinet; and wherein the first discharge channel is divided from the first supply channel by a partition.

19. The laundry treatment apparatus according to claim 18, wherein the second water discharge pipe comprises a flexible structure or an elastic material in at least a portion thereof.

20. The laundry treatment apparatus according to claim 1, further comprising:

a water discharge channel supported along an exterior of the body and configured to discharge washing water from the accommodation unit to the outside of the accommodation unit; and a discharge pipe configured to guide washing water supplied from the water discharge channel to the outside of the cabinet, wherein a portion of the water discharge channel that is connected to the discharge pipe comprises a flexible structure or an elastic material.

21. The laundry treatment apparatus according to claim 1, further comprising:

a water supply opening provided at the drawer and configured to be connected to an end portion of the water supply channel;

a through hole provided at the accommodation unit and configured to provide a passage for water from the water supply opening; and a recovery unit positioned between the water supply opening and the through hole and configured to:

recover moisture discharged from the accommodation unit out of the through hole, and return the moisture back into the accommodation unit through the through hole.

22. The laundry treatment apparatus according to claim 21, wherein the recovery unit comprises:

a first recovery part provided at the drawer to be positioned above the through hole and configured to condense steam discharged out of the through hole into condensed water; and a second recovery part positioned above the through hole and configured to guide the condensed water falling from the first recovery part back down into the through hole.

23. The laundry treatment apparatus according to claim 22, wherein the second recovery part comprises a recovery body protruding toward the first recovery part from an upper surface of the accommodation unit, the recovery body defining a body through hole that corresponds to the through hole, and wherein the first recovery part is configured to protrude toward the second recovery part from an upper surface of the drawer.

24. The laundry treatment apparatus according to claim 23, further comprising:

a reception recess formed at an upper surface of the accommodation unit and configured to be concave and having a diameter larger than a diameter of the through hole;

a body flange protruding from an outer surface of the recovery body and configured to contact an inner surface of the reception recess;

a flange through hole formed through the body flange and configured to provide a passage for condensed water to fall from the body flange into the reception recess; and a recovery hole configured to guide condensed water from the reception recess into the through hole, wherein the first recovery part is configured to have a maximum radial extent that is less than a maximum radial extent of the body flange.

25. The laundry treatment apparatus according to claim 24, wherein the first recovery part comprises a plurality of concentric protrusions from the first recovery part that are spaced apart in a radial direction and that define a plurality of walls of the first recovery part, wherein the plurality of concentric protrusions are arranged to define concentric circles about the water supply opening, and wherein the plurality of concentric protrusions comprise a bottom portion having a maximum radial extent that is larger than a maximum radial extent of the body through hole but smaller than a maximum radial extent of the body flange, and the concentric protrusion having the smallest radial extent having a smaller radial extent than the maximum radial extent of the body through hole.

26. The laundry treatment apparatus according to claim 1, wherein the accommodation unit comprises:

a tub provided in the drawer and configured to receive washing water; and a drum rotatably provided in the tub to contain laundry, wherein the drawer comprises a water supply opening through which the water supply channel is connected to the drawer, and an introduction opening through which laundry is put into the drawer is formed through the drawer, and wherein the tub comprises a through hole configured to provide a passage from the water supply opening to the drum, and a tub introduction port configured to provide a passage from the introduction opening to the drum.

27. The laundry treatment apparatus according to claim 26, further comprising an intermediate connecting member between the water supply opening and the through hole and comprising a flexible structure or an elastic material.

28. The laundry treatment apparatus according to claim 26, further comprising:

a door rotatably provided at the tub and configured to open and close the tub introduction port;

a sealing body provided at the door and configured to be fitted within the tub introduction port;

a first protrusion protruding from the sealing body and configured to contact an inner surface of the tub introduction port; and a second protrusion positioned above the tub introduction port and protruding from the sealing body to contact an upper surface of the tub.

29. The laundry treatment apparatus according to claim 1, further comprising a through hole configured to provide a passage for washing water to be introduced into the accommodation unit, wherein the water supply channel is configured to extend through the drawer and an end portion of the water supply channel is configured to be connected to the through hole.

30. The laundry treatment apparatus according to claim 29, wherein at least part of the water supply channel comprises a flexible structure or an elastic material.

31. The laundry treatment apparatus according to claim 29, wherein the end portion of the water supply channel that is positioned between the through hole and the drawer comprises a flexible structure or an elastic material.

32. The laundry treatment apparatus according to claim 1, further comprising a support configured to hold the accommodation unit in the drawer in a movable manner.

* * * * *